US005408533A

United States Patent [19]

Reiffin

[11] Patent Number: 5,408,533

[45] Date of Patent: Apr. 18, 1995

[54] MOTIONAL FEEDBACK SPEAKER SYSTEM WITH RADIALLY POLARIZED MAGNET AND UNDERHUNG VOICE-COIL

[76] Inventor: Martin Reiffin, 5439 Blackhawk Dr., Danville, Calif. 94506

[21] Appl. No.: 165,168

[22] Filed: Dec. 13, 1993

[51] Int. Cl.[6] ..... H04R 3/00

[52] U.S. Cl. ..... 381/96; 381/194; 381/199

[58] Field of Search ..... 381/96, 201, 194, 199

[56] References Cited

U.S. PATENT DOCUMENTS 5,321,762 6/1994 Stuart ..... 381/199

FOREIGN PATENT DOCUMENTS 0562954 9/1977 U.S.S.R. ..... 381/96

OTHER PUBLICATIONS

Loudspeakers, G. A. Briggs, 1958, p. 64.

Cheng, David K., *Field and Wave Electromagnetics*, p. 197, 1983.

*Primary Examiner*—Curtis Kuntz

*Assistant Examiner*—Mark D. Kelly

[57] ABSTRACT

A motional feedback loudspeaker system wherein the loudspeaker distortion is reduced by a negative feedback signal derived from the back electromotive force induced by the motion of the voice-coil within the magnet field. It is essential that the feedback signal be a linear function of the loudspeaker cone motion, and this is achieved by locating the voice-coil within a uniform elongated cylindrical magnetic field of substantially constant flux density and having an axial length substantially greater than the axial length of the voice-coil. Therefore the voice-coil is underhung so as to remain immersed within the uniform field even at peak displacements of the voice-coil during maximum excursions of the speaker cone. The uniform elongated magnetic field is preferably provided by a cylindrical radially polarized magnet of neodymium. In order to sense the back electromotive force due to the voice-coil motion the speaker is located within a bridge network so that the magnitude of voltage imbalance across the bridge is proportional to the cone velocity. A difference amplifier senses this voltage from which is derived the feedback signal which is fed degeneratively into an early amplification stage. This negative feedback reduces the nonlinear distortion of the loudspeaker, and also improves the transient response and frequency response.

20 Claims, 2 Drawing Sheets

MOTIONAL FEEDBACK SPEAKER SYSTEM WITH RADIALLY POLARIZED MAGNET AND UNDERHUNG VOICE-COIL

FIELD OF THE INVENTION

This invention relates to a motional feedback loudspeaker system wherein the loudspeaker distortion is reduced by a negative feedback signal derived from the back electromotive force generated by the motion of an underhung voice-coil within a radially polarized magnet field.

BACKGROUND OF THE INVENTION

In the art of audio sound reproduction it is well-known that the dynamic loudspeaker is more nonlinear and generates more distortion than all the other system components combined. This is particularly true at low frequencies which require large cone excursions where the stiffness of both the inner spider and the outer surround increases rapidly as the cone approaches its peak displacement, resulting in a nonlinear suspension compliance generating high distortion.

For example, in a typical high fidelity sound system at a frequency of about 40 Hz the total harmonic distortion of the amplifier might be of the order of 0.01%, whereas the distortion of the loudspeaker might range from about 4.0% to about 40.0%, depending upon the loudness. That is, the amplifier is almost perfectly linear with a distortion so low as to be almost unmeasureable, whereas the loudspeaker is extremely nonlinear with gross distortion quite evident to the ear. This vast difference is due in large part to the fact that the amplifier distortion is reduced by a large amount of negative feedback, whereas the conventional loudspeaker has no feedback whatever. A typical amount of feedback in an amplifier might be about 40 db which serves to reduce the nonlinear distortion by a factor of 100, or two orders of magnitude. It has long been recognized in the art that if negative feedback could be applied around the loudspeaker in an effective and economical manner then the present marginal fidelity of the loudspeaker might be greatly improved so as to approach the near perfect fidelity of the amplifier.

DESCRIPTION OF THE PRIOR ART

In the prior art there have been four different approaches in an attempt to correct the low-frequency nonlinear distortion by the application of motional feedback. The first approach generates the motional feedback signal by an accelerometer mounted on the speaker cone, and the second approach generates the signal by an electromagnetic metal detecting device which senses the movement of the metallic wire constituting the speaker voice-coil. Both of these approaches are capable of substantial reduction of nonlinear distortion at low frequencies, but are so expensive that they are used only in "high end" audiophile subwoofers.

The third approach unsuccessfully attempted to generate the feedback signal by locating the speaker within a bridge network so as to sense the back-emf (electromotive force) generated by the voice-coil moving within the magnetic field. In my U.S. Pat. No. 3,530,224 there is disclosed such a bridge arrangement wherein an overhung voice-coil within a conventional magnet structure was intended to provide an approximately constant number of effective field-cutting turns within the magnetic field as the voice-coil reciprocated during movement of the speaker cone. Also disclosing such a motional feedback bridge arrangement were later U.S. Pat. Nos. 3,889,060 and 5,031,22.

Although this bridge scheme was economical, it failed to reduce significantly the nonlinear distortion of the sound radiated by the speaker and was not commercially successful. I believe that this failure was primarily due to the nonuniformity of the magnetic flux lines cut by the moving voice-coil, and to the resulting nonlinearity of the induced back emf (electromotive force) and the feedback signal derived therefrom. The magnetic flux density was particularly nonuniform beyond the ends of the magnet gap where fringe effects occurred to distort the field. That is, the BL factor was not constant during large cone excursions as voice-coil turns at one end of the overhung voice-coil left the magnet gap and other turns at the opposite end of the voice-coil entered the gap.

Also, it was necessary to extend the voice-coil overhang beyond the magnet gap to a greater extent than usual in the attempt to maintain an approximately linear BL factor during large excursions of the speaker cone. This large overhang was disadvantageous in several respects. The resulting elongated voice-coil had a relatively large resistance. This reduced the speaker efficiency, and also caused increased heating of the voice-coil during large current flow. The resulting temperature increase of the voice-coil conductor raised its resistance so as to upset the initial D.C. balance of the bridge. Furthermore, this voice-coil heating problem was exacerbated by the inadequate heat conduction through the small area of heat transfer to the surrounding magnet iron, and the fact that the two overhung end portions of the voice-coil projected into the air beyond the magnet iron with no heat transfer to the iron. Also, to maintain the requisite flux density and efficiency the magnet gap was required to be relatively narrow, requiring smaller clearances, tighter tolerances and higher cost of manufacture, as well as increased danger of voice-coil rubbing against the surrounding magnet iron with even a slight misalignment of the voice-coil.

Still another attempt to reduce the low-frequency nonlinear distortion abandons the use of motional feedback and utilizes instead a radially polarized magnet structure and an underhung voice-coil suspended in the resulting uniform field of the elongated magnet gap. The approximately constant magnetic flux density cut by the voice-coil even during peak displacements of large cone excursions substantially eliminates the nonlinear distortion due to the nonuniform fields of conventional speakers. However, this arrangement does nothing to ameliorate the distortion due to the nonlinear compliances of the surround and spider, and may even exacerbate the problem by driving the cone to larger excursions with resulting greater suspension nonlinearity and output distortion than would be the case with a conventional magnet structure. Attempts to solve the problem by linearizing the suspension compliances of the surround and spider result in speakers which are prohibitively expensive for most applications and which nevertheless are less than linear.

SUMMARY OF THE INVENTION

It is therefore a primary object of the present invention to minimize the nonlinear distortion generated by dynamic loudspeakers at low frequencies where the cone and voice-coil undergo large excursions resulting in nonlinear suspension compliances of the surround and spider. This is achieved by the application of a negative feedback signal derived from the back emf (electromotive force) induced by the axial reciprocal movement of the voice-coil within the magnet field.

The preferred disclosed embodiment of the present invention comprises a novel combination of an amplifier driving a feedback bridge network including a dynamic loudspeaker having a radially polarized magnet structure with an underhung voice-coil. This speaker construction is used for the novel purpose of generating a linear back-emf which then enables the bridge network to provide a linear feedback signal which is applied degeneratively to an early stage of the amplifier.

It is critically important, and indeed essential, that the feedback signal be a substantially linear function of the loudspeaker cone motion. This linearity is provided in the preferred disclosed embodiment by locating the voice-coil within a uniform elongated cylindrical magnetic field of substantially constant flux density and having an axial length substantially greater than the axial length of the voice-coil. As a result the voice-coil is underhung so as to remain immersed within the uniform field of constant flux density even at peak displacements of the voice-coil during maximum excursions of the speaker cone.

The elongated uniform magnetic field is provided in the preferred embodiment by a cylindrical radially polarized magnet, preferably of neodymium. Heretofore in the prior art the radially polarized magnet structure and underhung voice-coil have been employed solely to partially reduce the nonlinearity of the forward transfer function of the loudspeaker. That is, it serves to assure that the driving force applied to the cone is a linear function of the voice-coil current. Expressed mathematically, the magnitude of the forward transfer function is determined in part by the following equation derived from Lorentz' law:

$$f=BLi$$

where f is the force driving the speaker cone, B is the magnetic flux density, L is the voice-coil conductor length immersed in the field, and i is the current through the voice-coil. By providing that the voice-coil be immersed in a constant flux density B throughout the entire excursion of the cone, the driving force is thereby a linear function of the voice-coil current i, and the forward transfer function is thereby partially linearized; that is, insofar as the force-current relation is concerned. However there still remains uncorrected the substantial nonlinearity and resulting severe distortion caused by the nonlinear suspension.

As distinct from this partial linearization of the forward transfer function provided by the radially polarized magnet and underhung voice-coil construction in the prior art, in the present invention the primary purpose of this speaker construction is to generate a back-emf voltage which accurately represents the voice-coil velocity so as to enable the derivation of a linear feedback signal proportional to either the velocity or acceleration of the speaker cone. That is, this speaker construction serves the novel function of linearizing the backward transfer function of the feedback system, rather than the forward transfer function as in the prior art. Expressed mathematically, the magnitude of the induced back emf and hence the backward transfer function of the feedback system is determined by the following equation derived from Lenz' law:

$$emf=BLv$$

where emf is the back electromotive force or induced voltage from which the feedback signal is derived, B and L are as defined above, and v is the velocity of the voice-coil within the magnetic field. By providing a constant flux density B for the entire excursion of the speaker cone the emf is directly proportional to the voice-coil velocity v. Hence there may be derived from this linear back emf a feedback signal which is a linear function of either the cone velocity or the cone acceleration, as may be preferred.

The resulting linear feedback substantially reduces the nonlinearity of the overall transfer function of the amplifier-speaker combination and counteracts the harmonic and intermodulation distortion generated by the nonlinear suspension compliances of the speaker surround and spider. The result is an economical system with a substantial reduction in nonlinear distortion at low frequencies, as well as the other benefits of negative feedback such as reduced transient distortion and more uniform frequency response.

DETAILED DESCRIPTION

Figure 1:
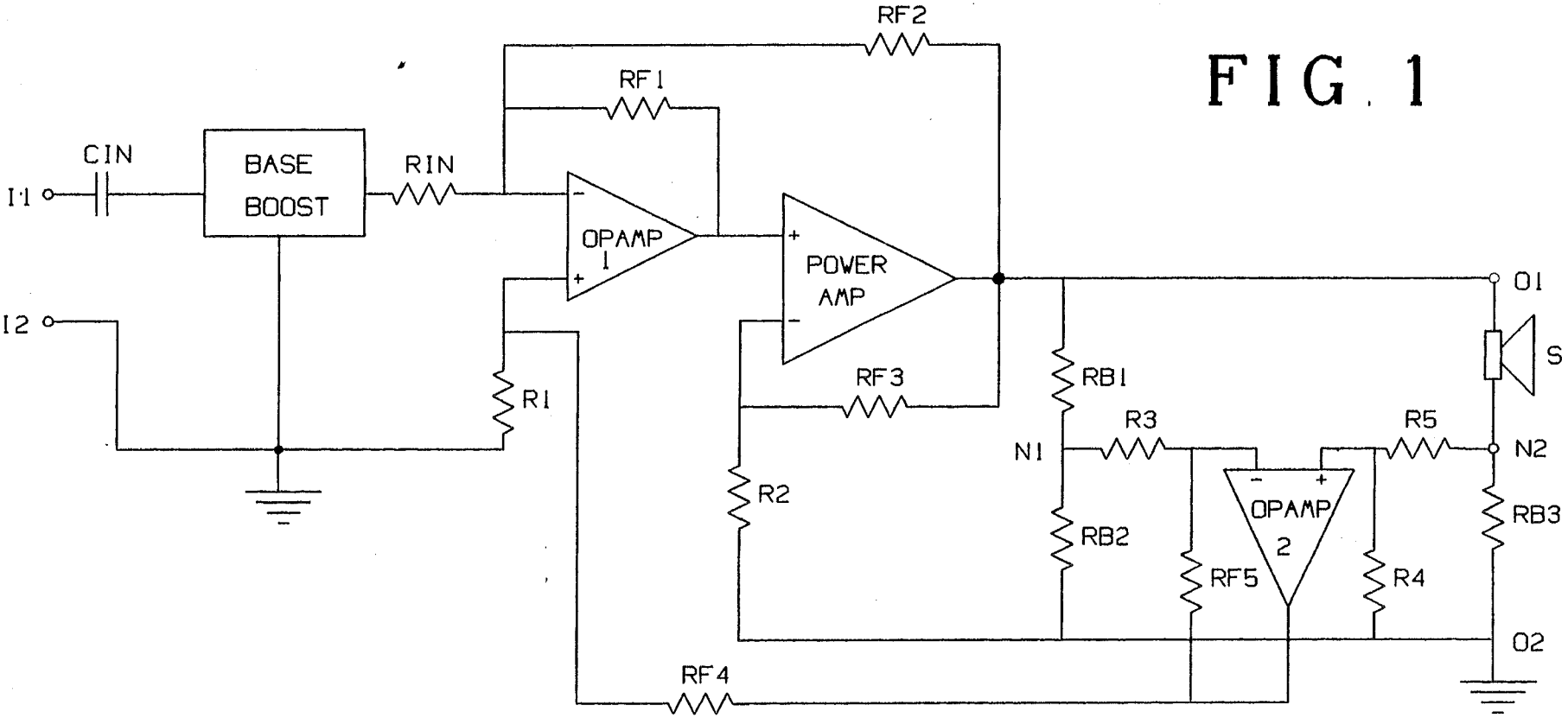
FIG. 1 is a schematic circuit diagram showing the amplifier circuitry and the speaker within the bridge network for generating a motional feedback signal fed to an early stage of the amplifier.

Referring now to FIG. 1 in more detail, the amplifier circuitry comprises an equalizer filter designated BASS BOOST in cascade with an initial operational amplifier stage designated OP AMP 1. The output of the latter drives the input of a conventional power amplifier designated POWER AMP driving a speaker S constituting one element of a bridge network also comprising resistors RB1,RB2 and RB3. A difference amplifier designated OP AMP 2 senses the voltage difference across the bridge to generate a feedback signal, and injects the feedback signal into an input of the initial operational amplifier stage 1.

The hot input terminal I1 is coupled by capacitor CIN to the base boost filter which equalizes the low-frequency rolloff caused by the velocity feedback. The other input terminal I2 is grounded. A resistor RIN connects the output of the equalizer filter to the inverting input of operational amplifier 1 and the output of the latter is coupled to the noninverting input of the power amplifier having a hot output terminal O1 connected to one terminal of speaker S and a grounded output terminal O2. The other terminal of speaker S is connected through the resistor RB3 to the ground. The other two resistors RB1 and RB2 of the bridge are connected in series between the hot output terminal O1 and the grounded output terminal O2.

For low frequency applications the inductance of the speaker voice-coil is negligible and the blocked voice-coil impedance (when the cone is stationary) is effectively merely resistive without a substantial reactive component. For these low-frequency applications the bridge impedance elements RB1,RB2,RB3 may be resistors since these would be capable of balancing the resistive voice-coil. However, if it is desired to use the present feedback system at higher frequencies where the inductance of the voice-coil becomes significant then one or more of the bridge impedance elements may include a reactance component, such as an inductor in series with resistor RB3 or a capacitor in parallel with resistor RB2.

The bridge comprising resistors RB1,RB2 and RB3 and speaker S would be substantially balanced if movement of the speaker cone were blocked, and there would then be no significant voltage difference across the bridge between the node N1 at the junction of resistors RB1,RB2 and the opposite node N2 at the junction of the speaker and resistor RB3, notwithstanding the voltage swing at output terminal O1. That is, the ratio of the resistance of RB1 to that of RB2 is equal to the ratio of the speaker voice-coil resistance to that of RB3. For example, in low-frequency applications the ratio of the resistance of RB1 to that of RB2 may be 10:1, and the ratio of the D.C. resistance of the voice-coil to the resistance of RB3 would then also be 10:1.

However, the speaker cone and voice-coil are free to move, and the motion of the voice-coil within the magnetic field of the magnet gap generates a back emf (electromotive force) which effectively raises the impedance of the voice-coil so as to unbalance the bridge. The resulting voltage difference across the bridge at nodes N1,N2 is sensed by difference amplifier 2 which transmits this voltage difference as a negative feedback signal for injection into the noninverting input of the operational amplifier 1. If the speaker BL factor (flux density B times effective voice-coil conductor length L) is constant throughout the movement of the voice-coil then the back-emf and hence the feedback signal will be linearly related to the velocity of the speaker cone. This linearity is critically important to the effectiveness of the feedback to reduce the speaker distortion, since any nonlinearity in the feedback signal will be amplified and fed to the speaker as a distortion of the original signal.

When large currents flow through the speaker voice-coil and bridge resistor RB3 these components become hot and their respective resistances will tend to increase. In order to maintain the bridge balance it is desirable that the percentage increase in the voice-coil resistance be approximately equal to that of the resistance of bridge element RB3. Depending upon the characteristics of the magnet structure of the particular speaker design, the bridge resistor RB3 may be provided with either a heat-sink to radiate the heat if cooling is required to match increased resistance of the voice-coil, or a thermal insulator to retain the heat if the voice-coil resistance tends to have the greater percentage increase as the current heats both components.

This heating problem is substantially reduced by the radial magnet and underhung voice-coil construction of the preferred embodiment of the invention. This construction provides substantial cooling of the voice-coil because of the large heat conducting surface area between the voice-coil and the iron cylinder which surrounds it. As explained above, in conventional overhung voice-coil constructions the overhanging portions of the voice-coil have no adjacent iron to conduct away the heat, and also the axial length of the cylindrical magnet gap is relatively short so as to provide only a relatively small area for heat transfer from the voice-coil to the adjacent iron of the magnet structure.

The noninverting input of the difference operational amplifier OP AMP 2 is connected through resistor R5 to the bridge node N2 and through resistor R4 to the ground. The inverting input of difference amplifier 2 is connected through resistor R3 to the bridge node N1 at the junction of bridge resistors RB1,RB2 and also through resistor RF5 to the output of difference amplifier 2. The output of the latter is connected through feedback resistor RF4 to the noninverting input of operational amplifier OP AMP 1. This noninverting input is also connected to one end of resistor R1 having its other end grounded as shown.

The power amplifier is preferably direct-coupled to minimize phase shift and feedback instability at low frequencies. To minimize the DC offset at the output O1 there are provided several feedback resistors which also serve to reduce the distortion of the operational and power amplifiers. More specifically, a feedback resistor RF1 extends from the output of operational amplifier OP AMP 1 to the inverting input of the latter, as does also the feedback resistor RF2 extending from the output of the power amplifier. Another feedback resistor R3 extends from the power amplifier output to its inverting input.

Figure 2:
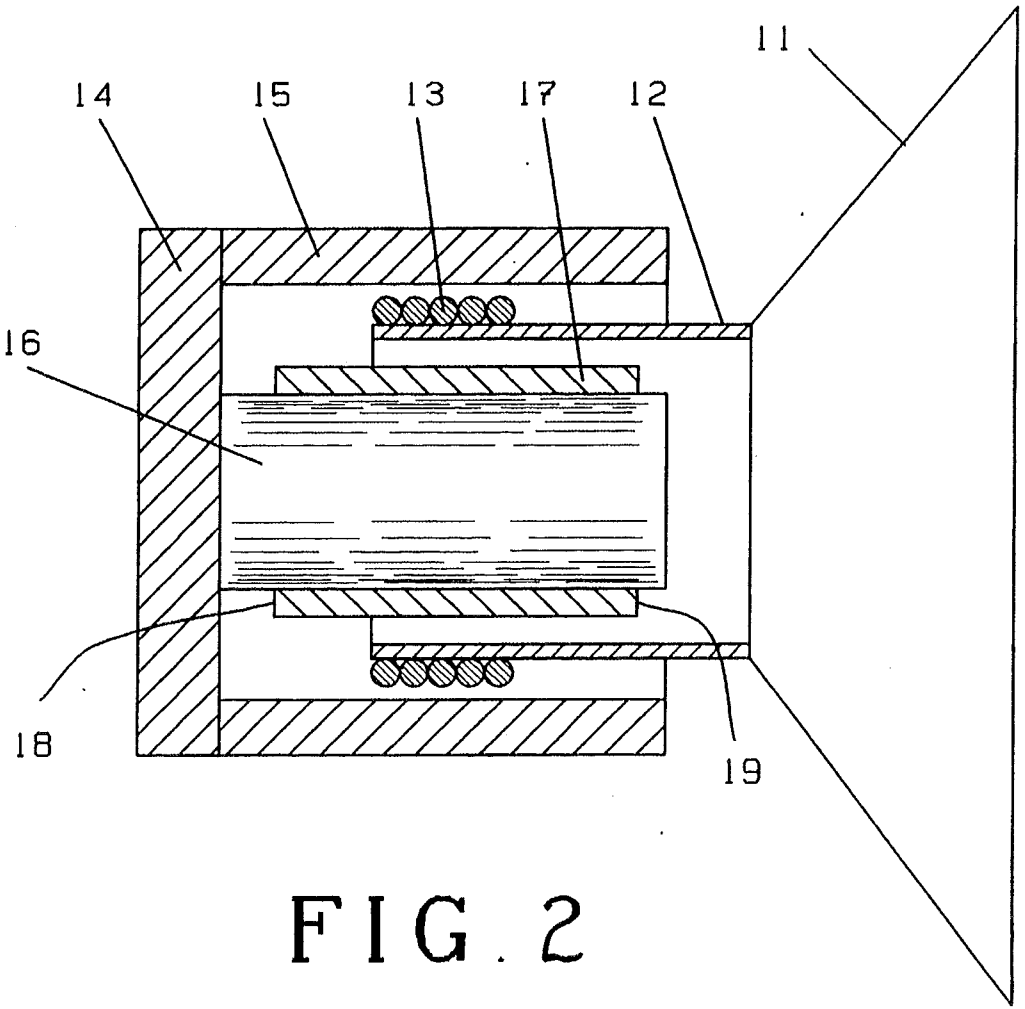
FIG. 2 is a schematic sectional view of the speaker in accordance with the preferred embodiment and showing the underhung voice-coil within an elongated magnet gap having a uniform field with a constant flux density provided by a radially polarized magnet.

Referring now to FIG. 2, there is shown the speaker magnet structure which achieves the required substantially constant BL factor and hence the essential linearity of the induced back-emf and the feedback signal derived therefrom. The ferromagnetic return structure of the magnet system comprises a circular back plate 14 and an outer hollow cylinder 15 coaxially enclosing a central cylindrical solid core 16. Mounted coaxially around the latter is a cylindrical magnet 17 preferably formed of neodymium. The magnet 17 is radially polarized. That is, the flux lines extend in a direction radially outward (vertically up and down as viewed in the drawing) from the common axis of core 16 and magnet 17, then rearwardly (horizontally in the drawing) through return cylinder 15, then radially inward (vertically) through back plate 16, then forwardly (horizontally) through core 16, and then radially outward (vertically) again through magnet 17. It will be seen that the cylindrical magnet gap coaxially surrounding magnet 17 extends from the rear end 18 of magnet 17 to the front end 19 thereof and is relatively long.

A voice-coil 13 is wound around a cylindrical former 12 secured to the rear apex of a speaker cone 11. For clarity in illustration, the spider and surround have been omitted from the drawing, and the gap width and voice-coil clearances have been exaggerated. It is important to note that the voice-coil 13 is underhung. That is, the axial length of the voice-coil 13 (the horizontal dimension in the drawing) is substantially shorter than the axial length of the cylindrical magnet gap. As a result, even at peak displacement during large excursions of the speaker cone 11 the voice-coil 13 will remain entirely immersed within a uniform magnetic field having a substantially constant flux density. As a result, the back-emf induced by the axial voice-coil motion will be directly proportional to the cone velocity and the feedback signal derived therefrom will be a linear function of the cone motion.

If desired, an op amp circuit (not shown) may be employed to differentiate the velocity proportional induced emf so as to obtain a feedback signal proportional to the cone acceleration which signal may then be injected into the feedback injection node at the noninverting input of operational amplifier OP AMP 1, as disclosed in said U.S. Pat. No. 3,889,060. In this modification, the initial base-boost equalizer stage may not be necessary. However, this modification is less advantageous than the preferred embodiment because the differentiation operation amplifies the noise and distortion components of the feedback signal, and also produces phase shift which reduces the feedback stability margin of the overall system.

Another feasible modification of the invention would be to utilize the bridge arrangement of U.S. Pat. No. 3,530,244 so that node N2 at the junction of speaker S and the bridge element RB3 is grounded. This would permit the feedback signal to be taken directly from node N1 at the junction of bridge elements RB1 and RB2 without need for the difference amplifier OP AMP 2. However, this arrangement requires a floating power supply, so that each channel of a stereo system would require its own individual supply.

For less critical applications, or where cost of manufacture is not a primary consideration, a conventional axially polarized magnet structure may be substituted for the neodymium radially polarized magnet structure of the preferred embodiment so as to provide an elongated cylindrical magnet gap field within which the underhung voice-coil may remain entirely immersed throughout the reciprocal movement of the cone. In the present state of the art of magnetic materials this modification would either suffer a reduced magnetic flux density resulting in decreased sensitivity and efficiency of the speaker, or else would require an unusually large and expensive magnet if a normally high flux density were required for the particular application.

Still another modified embodiment of the present invention alleviates a problem that presents difficulties for even the most expensive and sophisticated motional feedback systems of the prior art; that is, the tendency of the feedback to drive the amplifier into severe clipping and to drive the cone to excessive excursions in response to large low-frequency input signals. This results in audible distortion and may damage the loudspeaker. This tendency may be readily controlled by the following modification of the disclosed circuitry. A portion of the velocity-proportional feedback signal may be fed to a conventional integrator circuit (not shown) to integrate and thereby convert this velocity signal to a displacement signal proportional to the instantaneous excursion of the voice-coil and cone. This displacement signal may then be transmitted to a conventional dead-zone filter (not shown) which passes only those peak portions of the displacement signal which correspond to cone excursions which exceed a predetermined excursion limit. These peaks of the displacement signal are then fed back degeneratively to the feedback injection node of the early amplification stage so as to reduce the signal driving the amplifier and thereby limit the cone excursion. The result is in effect a soft clipping of the drive signal to prevent excessive excursions of the cone and to prevent hard clipping of the amplifier. Also, the low level circuitry of the early amplification stage is capable of much faster recovery from this soft clipping as compared with the typical delayed recovery from hard clipping of the conventional power amplifier.

It is to be understood that the embodiments disclosed herein are merely illustrative of several of the many forms which the invention may take in practice and that numerous modifications thereof will readily occur to those skilled in the art without departing from the invention as delineated in the appended claims which are to be construed as broadly as permitted by the prior art.

I claim:

1. A motional feedback loudspeaker system comprising a dynamic loudspeaker, an amplifier, and a motional feedback means, said loudspeaker including a magnet structure having a hollow cylindrical radially-polarized magnet and an elongated cylindrical magnet gap coaxial with said magnet and of a predetermined axial length with the magnetic flux of said magnet extending radially through said magnet and then through said cylindrical magnet gap to provide in the cylindrical gap a substantially uniform radial magnetic field of substantially constant flux density therein throughout said axial length thereof, said loudspeaker further including a cylindrical voice-coil within said cylindrical magnet gap and coaxial therewith and having an axial length less than said magnet gap axial length so as to be underhung with respect to said gap and so as to remain immersed within said uniform radial magnetic field during large axial displacements of said voice-coil, said loudspeaker further including a speaker cone secured to said voice-coil and a pair of speaker terminals connected to said voice-coil, said amplifier having a feedback injection node, network means connecting said amplifier to said speaker terminals, said motional feedback means including signal generating means responsive to the motion of said speaker cone for generating a motional feedback signal, said signal generating means comprising means responsive to a back electromotive force induced by cutting said radial magnetic field by said voice-coil as the voice-coil moves axially within said cylindrical magnet gap, and means for injecting said feedback signal into said amplifier feedback injection node.

2. A motional feedback loudspeaker system as set forth in claim 1 wherein said network means comprises means for sensing the magnitude of said back electromotive force induced during the axial movement of the voice-coil, and a feedback network connected to said feedback injection node for injecting said feedback signal into said amplifier injection node.

3. A motional feedback loudspeaker system as set forth in claim 2 wherein said network means comprises a bridge network including a plurality of impedance elements and connected to said speaker terminals so as to include said voice-coil as one of the impedance elements of the bridge, said bridge network having a pair of nodes having an instantaneous voltage therebetween proportional to said back electromotive force generated by the axial motion of the voice-coil within said radial magnetic field of the cylindrical magnet gap, and differential amplifier means for sensing the voltage difference between said bridge network nodes so as to generate a motional feedback signal functionally related to said voltage difference.

4. A motional feedback loudspeaker system as set forth in claim 3 wherein a first and second of said bridge impedance elements are connected in series at a first of said bridge network nodes, said loudspeaker voice-coil constituting a third of said bridge impedance elements and connected in series with a fourth of said bridge impedance elements at the other of said bridge network nodes and in series with said fourth impedance element, said first, second and fourth bridge impedance elements and said voice-coil each having an electrical impedance, the ratio of the magnitudes of the impedances of said first and second bridge impedance elements being approximately equal to the ratio of the magnitudes of said voice-coil and said fourth bridge impedance element when said voice-coil is stationary, whereby when the voice-coil is stationary the bridge network is balanced and the bridge network nodes are substantially at the same voltage, and when the voice-coil moves within the magnetic field the resulting back electromotive force increases the effective impedance of the loudspeaker so as to unbalance the bridge and generate a voltage difference across the bridge network nodes substantially proportional to the voice-coil velocity.

5. A motional feedback loudspeaker system as set forth in claim 4 wherein said amplifier has an input terminal, said feedback signal being proportional to the voice-coil velocity, and a bass-boost equalizer connected to said amplifier input terminal to boost the base response of the system and thereby counteract a bass rolloff in the frequency response produced by the velocity-proportional feedback.

6. A motional feedback loudspeaker system as set forth in claim 1 wherein said amplifier has an input terminal, said feedback signal being proportional to said voice-coil velocity, and a bass-boost equalizer connected to said amplifier input terminal to equalize the low-frequency response of the system and thereby counteract a base rolloff in the frequency response produced by the velocity-proportional feedback.

7. A motional feedback loudspeaker system comprising a dynamic loudspeaker, an amplifier drivingly connected to said loudspeaker, and motional feedback means connected to said loudspeaker and said amplifier, said loudspeaker having a cone and suspension means for suspending said cone for axial reciprocal motion of the cone between predetermined maximum limits, said loudspeaker further comprising means for generating a back electromotive force which is a substantially linear function of the cone velocity throughout said motion of the cone between said predetermined limits.

said generating means including a magnet structure having a cylindrical magnet gap with a magnetic field therein, a cylindrical voice-coil coaxially suspended within said cylindrical magnet gap and secured to said speaker cone and having an axial length substantially less than the axial length of said magnet gap, and a pair of speaker terminals connected to said voice-coil, said voice-coil thereby being underhung with respect to the gap so as to remain entirely immersed within the magnetic field throughout axial reciprocal displacements of the speaker cone to said maximum limits, whereby a back electromotive force is induced by cutting of said magnetic field by said voice-coil as the voice-coil moves axially within said cylindrical magnet gap, said motional feedback means including network means connected between said amplifier and said speaker terminals for sensing said back electromotive force induced during the axial movement of the voice-coil, means for generating a feedback signal functionally related to said induced back electromotive force, said amplifier having a feedback injection node, and said motional feedback means further including a feedback network connected to said feedback injection node for injecting said feedback signal into said injection node.

8. A motional feedback system as set forth in claim 7 wherein said magnet structure comprises a cylindrical radially polarized magnet coaxial with respect to said cylindrical magnet gap and said cylindrical voice-coil so as to provide in the gap magnetic flux lines extending radially with respect to the common axis of said magnet, gap and voice-coil.

9. A motional feedback loudspeaker system as set forth in claim 7 wherein said network means comprises a bridge having a plurality of impedance elements connected to said speaker terminals so as to include said loudspeaker as one of the impedance elements of the bridge, said bridge including a pair of nodes having therebetween an instantaneous voltage which is a function of said back electromotive force induced by the axial motion of the voice-coil within said magnetic field of the cylindrical magnet gap, and said feedback signal generating means including means for sensing the instantaneous voltage difference between said bridge network nodes.

10. A motional feedback loudspeaker system as set forth in claim 9 wherein said amplifier comprises a pair of output terminals, a first and second of said bridge impedance elements are connected at a first of said bridge network nodes and in series between said amplifier output terminals, said loudspeaker voice-coil constituting a third element of said bridge impedance elements and connected to a fourth element of said bridge impedance elements at the other of said bridge network nodes, said voice-coil and said fourth impedance element extending in series between said amplifier output terminals, said first, second and fourth bridge impedance elements and said voice-coil each having an electrical impedance, the ratio of the magnitudes of the impedances of said first and second bridge impedance elements being approximately equal to the ratio of the magnitudes of said voice-coil and said fourth bridge impedance element when said voice-coil is stationary, whereby when the voice-coil is stationary the bridge network is balanced and the bridge network nodes are substantially at the same voltage, and when the voice-coil moves within the magnetic field the resulting induced back electromotive force serves to unbalance the bridge and generate an instantaneous voltage difference across the bridge network nodes.

11. A motional feedback loudspeaker system as set forth in claim 10 wherein said amplifier has an input terminal, said feedback signal being proportional to said instantaneous voice-coil velocity, and a bass-boost equalizer connected to said amplifier input terminal to equalize the low-frequency response of the system and thereby counteract a base rolloff in the frequency response produced by the velocity-proportional feedback.

12. A motional feedback loudspeaker system as set forth in claim 11 wherein said magnet structure comprises a cylindrical radially polarized magnet coaxial with respect to said cylindrical magnet gap and said cylindrical voice-coil so as to provide magnetic flux lines extending radially with respect to the common axis of said magnet, gap and voice-coil.

13. A motional feedback loudspeaker system as set forth in claim 7 wherein said network means comprises a bridge network including a plurality of impedance elements and connected to said speaker terminals so as to include said voice-coil as one of the impedance elements of the bridge, said bridge network having a pair of nodes having an instantaneous voltage therebetween proportional to said back electromotive force generated by the axial motion of the voice-coil within said radial magnetic field of the cylindrical magnet gap, and differential amplifier means for sensing the voltage difference between said bridge network nodes so as to generate a motional feedback signal proportional to said voltage difference.

14. A motional feedback loudspeaker system as set forth in claim 13 wherein a first and second of said bridge impedance elements are resistors connected in series at a first of said bridge network nodes, said loudspeaker voice-coil constituting a third of said bridge impedance elements and connected in series with a fourth of said bridge impedance elements at the other of said bridge network nodes and in series with said fourth impedance element, said first, second and fourth bridge impedance elements and said voice-coil each having an electrical resistance, the ratio of the magnitudes of the resistances of said first and second bridge impedance elements being substantially equal to the ratio of the magnitudes of the resistances of said speaker voice-coil and said fourth bridge impedance element, whereby when the voice-coil is stationary the bridge network is balanced and the bridge network nodes are substantially at the same voltage, and when the voice-coil moves within the magnetic field the resulting back electromotive force increases the impedance of the loudspeaker so as to unbalance the bridge and generate a voltage difference across the bridge network nodes substantially proportional to the voice-coil velocity.

15. A motional feedback loudspeaker system comprising a dynamic loudspeaker, an amplifier drivingly connected to said loudspeaker, and motional feedback means connected to said loudspeaker and said amplifier, said loudspeaker having a magnet structure including a cylindrical magnet and a cylindrical magnetic flux return element coaxial with said magnet, said magnet and said return element each having a cylindrical surface with each surface spaced radially from the other surface to provide therebetween a cylindrical magnet gap coaxial with said magnet and said return element, said cylindrical magnet gap extending axially from a forward end of the magnet to a rear end thereof so as to be coextensive in axial length with said magnet, said magnet being radially polarized throughout its axial length so as to generate a radial magnetic field having magnetic flux extending radially through said magnet and then radially from said magnet cylindrical surface and then radially through said cylindrical magnet gap to said cylindrical surface of the return element, said radial magnetic field being uniform throughout the axial length of the cylindrical magnet gap, said loudspeaker having a cone and suspension means for suspending said cone for axial reciprocal movement between predetermined maximum limits, a cylindrical voice-coil coaxially suspended within said cylindrical magnet gap and secured to said cone, said voice-coil having an axial length substantially less than the axial length of said cylindrical magnet gap so as to be underhung with respect to the gap and so as to remain entirely immersed within the uniform magnetic field throughout axial reciprocal displacements of the cone to said maximum limits, whereby as the voice-coil reciprocates axially within said magnet gap to cut said magnetic flux of uniform density there is induced in the voice-coil a back electromotive force which is a linear function of the instantaneous velocity of the voice-coil and cone, said motional feedback means including network means for sensing said back electromotive force induced during the reciprocal movement of the voice-coil, means for generating a feedback signal functionally related to said sensed back electromotive force, said amplifier having a feedback injection node, and said motional feedback means including a feedback network for injecting said feedback signal into said amplifier injection node.

16. A motional feedback loudspeaker system as set forth in claim 15 wherein said network means comprises a bridge having a plurality of impedance elements connected to said speaker terminals so as to include said loudspeaker as one of the impedance elements of the bridge, said bridge including a pair of nodes having an instantaneous voltage therebetween proportional to said back electromotive force induced by the axial motion of the voice-coil within said magnetic field of the cylindrical magnet gap, and said feedback signal generating means including a difference amplifier for sensing the instantaneous voltage difference between said bridge network nodes so as to generate a motional feedback signal functionally related to said voltage difference.

17. A motional feedback loudspeaker system as set forth in claim 16 wherein said amplifier comprises a pair of output terminals, a first and second of said bridge impedance elements are connected at a first of said bridge network nodes and in series between said amplifier output terminals, said loudspeaker voice-coil constituting a third element of said bridge impedance elements and connected to a fourth element of said bridge impedance elements at the other of said bridge network nodes, said voice-coil and said fourth impedance element extending in series between said amplifier output terminals, said first, second and fourth bridge impedance elements and said voice-coil each having an electrical impedance, the ratio of the magnitudes of the impedances of said first and second bridge impedance elements being approximately equal to the ratio of the magnitudes of said voice-coil and said fourth bridge impedance element, whereby when the voice-coil is stationary the bridge network is balanced and the bridge network nodes are substantially at the same voltage, and when the voice-coil moves within the magnetic field the resulting induced back electromotive force increases the impedance of the loudspeaker so as to unbalance the bridge and generate an instantaneous voltage difference across the bridge network nodes proportional to the instantaneous velocity of the voice-coil.

18. A motional feedback loudspeaker system as set forth in claim 15 wherein said magnet structure further comprises an inner central cylindrical solid core member and an outer cylindrical casing member, with one of said members serving as said return element, said cylindrical magnet being in the form of a hollow sleeve having an inner cylindrical surface enclosing said core at a forward end of the core and coaxial therewith, and a back plate fixed to a rear end of said outer casing member and fixed to a rear end of said core, said radial magnetic flux flowing from said magnet radially through said magnet gap and then axially rearward through one of said members to said backplate and then radially through the backplate to a rear end of the other member and then axially forward through the latter to said magnet to complete a magnetic circuit.

19. A motional feedback loudspeaker system as set forth in claim 18 wherein said network means comprises a bridge having a plurality of impedance elements connected to said speaker terminals so as to include said loudspeaker as one of the impedance elements of the bridge, said bridge including a pair of nodes having an instantaneous voltage therebetween proportional to said back electromotive force induced by the axial motion of the voice-coil within said magnetic field of the cylindrical magnet gap, and said feedback signal generating means including a difference amplifier for sensing the instantaneous voltage difference between said bridge network nodes so as to generate a motional feedback signal functionally related to said voltage difference.

20. A motional feedback loudspeaker system as set forth in claim 19 wherein said amplifier comprises a pair of output terminals, a first and second of said bridge impedance elements are connected at a first of said bridge network nodes and in series between said amplifier output terminals, said loudspeaker voice-coil constituting a third element of said bridge impedance elements and connected to a fourth element of said bridge impedance elements at the other of said bridge network nodes, said voice-coil and said fourth impedance element extending in series between said amplifier output terminals, said first, second and fourth bridge impedance elements and said voice-coil each having an electrical impedance, the ratio of the magnitudes of the impedances of said first and second bridge impedance elements being approximately equal to the ratio of the magnitudes of said voice-coil and said fourth bridge impedance element, whereby when the voice-coil is stationary the bridge network is balanced and the bridge network nodes are substantially at the same voltage, and when the voice-coil moves within the magnetic field the resulting induced back electromotive force increases the impedance of the loudspeaker so as to unbalance the bridge and generate an instantaneous voltage difference across the bridge network nodes proportional to the instantaneous velocity of the voice-coil.

* * * * *